US008591144B1

(12) United States Patent
Bean et al.

(10) Patent No.: US 8,591,144 B1
(45) Date of Patent: Nov. 26, 2013

(54) MIXER AND PLACER PAVING SYSTEMS

(75) Inventors: Jeffrey M. Bean, Reno, NV (US); Brian M. Graham, Reno, NV (US); Clifford L. VanRonk, Reno, NV (US); Gregory S. Gere, Sparks, NV (US)

(73) Assignee: Q & D Construction, Inc., Sparks, NV (US)

( * ) Notice: Subject to any disclaimer, the term of this patent is extended or adjusted under 35 U.S.C. 154(b) by 13 days.

(21) Appl. No.: 13/429,251

(22) Filed: Mar. 23, 2012

(51) Int. Cl.
*E01C 19/00* (2006.01)
*E01C 19/12* (2006.01)

(52) U.S. Cl.
USPC ..... 404/101; 404/105; 404/118

(58) Field of Classification Search
USPC ..... 404/101–103, 111, 114, 118
See application file for complete search history.

(56) References Cited

U.S. PATENT DOCUMENTS

| | | | | |
|---|---|---|---|---|
| 3,310,293 | A * | 3/1967 | Zimmerman | 366/6 |
| 3,905,586 | A | 9/1975 | Wall, Jr. | |
| 4,072,435 | A | 2/1978 | Coho et al. | |
| 5,044,819 | A * | 9/1991 | Kilheffer et al. | 404/72 |
| 5,098,481 | A | 3/1992 | Monlux | |
| 5,354,145 | A * | 10/1994 | Sterner | 404/75 |
| 6,467,992 | B1 | 10/2002 | Dietrich | |
| 6,769,836 | B2 | 8/2004 | Lloyd | |
| 2003/0035688 | A1 * | 2/2003 | Vance et al. | 404/98 |
| 2011/0255918 | A1 * | 10/2011 | Worsley et al. | 404/84.1 |

* cited by examiner

*Primary Examiner* — Raymond W Addie
(74) *Attorney, Agent, or Firm* — Woodcock Washburn LLP

(57) ABSTRACT

A system for delivering a paving material to a point including a frame, one or more aggregate bins coupled to the frame at a front position relative to a forward direction of travel of the system. The aggregate bins configured to hold an aggregate material.

22 Claims, 17 Drawing Sheets

SIDE VIEW

SIDE VIEW

FRONT VIEW

SIDE VIEW

SIDE VIEW

TOP VIEW

SIDE VIEW

TOP VIEW

SIDE VIEW

TOP VIEW

SIDE VIEW

TOP VIEW

SIDE VIEW

MIXER AND PLACER PAVING SYSTEMS

CROSS-REFERENCES TO RELATED APPLICATIONS

Not applicable.

BRIEF DESCRIPTION

A front-loading mixer and placer paving system may have one or more aggregate bins positioned toward the front of the system, which may allow the aggregate bins to be loaded with aggregate by another vehicle in the same traffic lane while the system is in operation. The front-loading system may have a conveyor belt positioned under the aggregate bin that moves aggregate from the aggregate bin to a mixing auger located towards the rear of the front-loading mixer and placer paving system. As aggregate enters the mixing auger, it is mixed with binding materials (e.g., resins, catalysts, and chemical accelerators). The mixed material may be discharged from the mixing auger for placement onto a surface to be paved, after which the mixture hardens.

In embodiments, the system may include a screed located at the rear of the front-loading mixer and placer paving system that may spread and level the mixture (e.g., mixed material) after placement on the surface. In embodiments, the system may have a flow gate positioned at the bottom of the aggregate bins and above the conveyor belt that is used to control the amount and height of the aggregate placed on the conveyor belt for transporting to the mixing auger. In embodiments, the system may have a baffle located at the bottom of the aggregate bin that may control the transfer of the load of aggregate onto the conveyor belt. By regulating how much of the aggregate can reach the conveyor belt at one time, the conveyor belt may serve to lessen the overall load on the conveyor belt.

The front-loading mixer and placer paving system may mix the aggregate and binding material along with placing, spreading, and leveling the mixture without the need for additional paving apparatus.

STATEMENTS AS TO THE RIGHTS TO INVENTIONS MADE UNDER FEDERALLY SPONSORED RESEARCH OR DEVELOPMENT

Not applicable.

REFERENCE TO A "SEQUENCE LISTING," A TABLE, OR A COMPUTER PROGRAM LISTING APPENDIX SUBMITTED ON A COMPACT DISK

Not applicable.

BACKGROUND

In conventional mixing and/or paving systems, a driver cab may be positioned at the front of the paving system with an aggregate bin located behind the driver cab. During a paving operation for a traffic lane, a loading vehicle or other vehicle bearing aggregate will typically have to approach the mixing/paving system from a different lane due to the location of the aggregate bins relative to the loading vehicle in order to refill the aggregate bins from the side. More specifically, the conventional mixing/paving system will have to halt forward movement and cease paving operations while a vehicle is driven into close proximity of the aggregate bins of the conventional mixing/paving system, which needs to be done to allow a vehicle to accurately release aggregate into the aggregate bin. In some situations, where the operation of the conventional mixing/paving system is in an area with limited access to the lane being paved from the side, the conventional mixing/paving system is moved out of the traffic lane being paved, the aggregate bin is refilled, and the conventional mixing/paving system is moved back to the traffic lane being paved to resume paving operations. Further, in conventional mixing/paving systems, the mixing of the aggregate and binding material is implemented in one device and the placing of the mixed aggregate and binding material is performed by another device.

DETAILED DESCRIPTION

Figure 1:
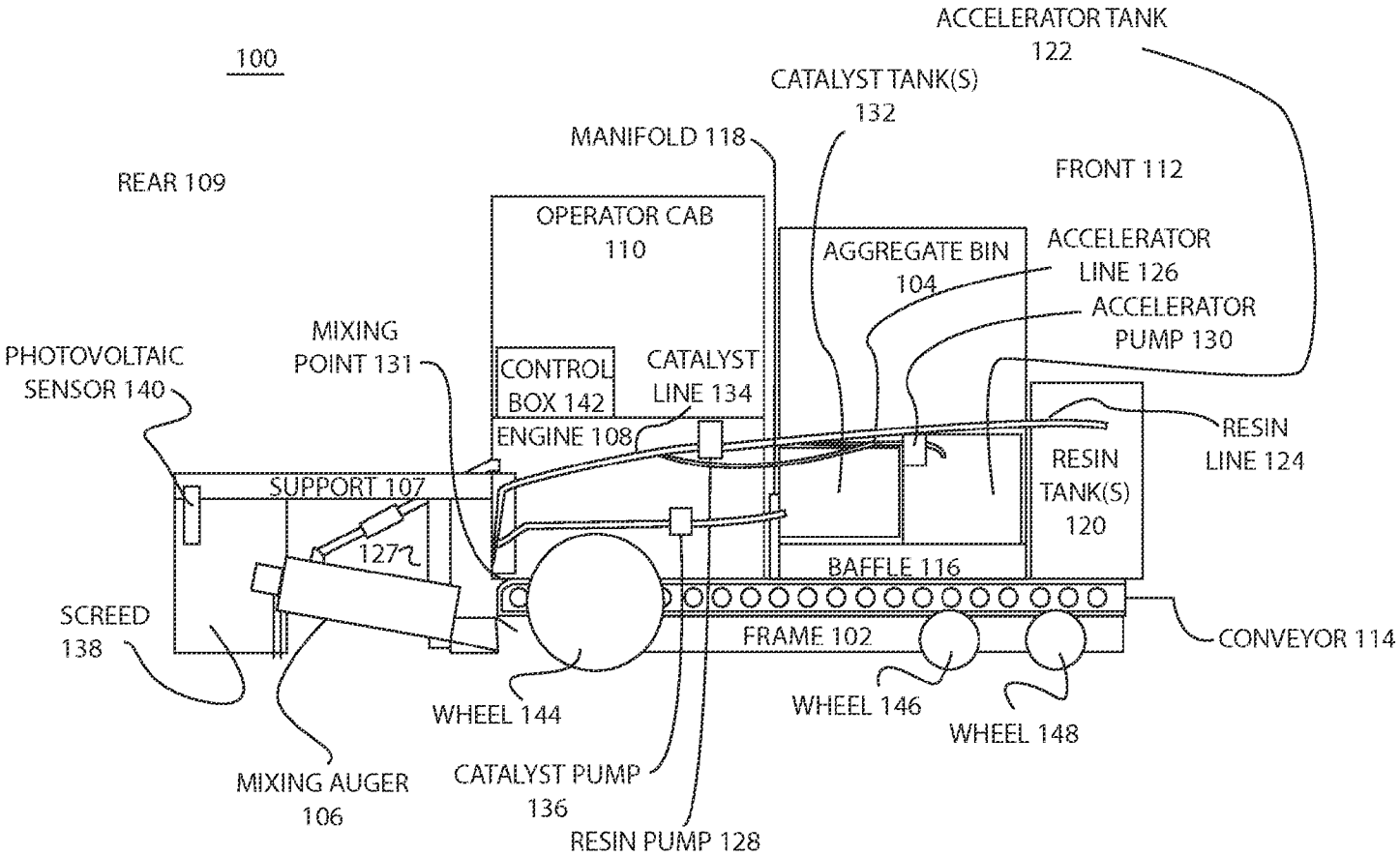
FIG. 1 is a side view illustrating a mixer and placer paving system in accordance with an embodiment.

In FIG. 1, a paving system 100 may include a frame 102 about which the paving system may be assembled. Paving system 100 may include an aggregate bin 104 that may be coupled to frame 102 and a mixing auger 106, that may be a dual auger, that may be coupled to frame 102. Mixing auger 106 may include a rotating helical blade called a "flighting" that acts as a screw. Rotation of the flighting may cause matter that is deposited at the end of mixing auger 106 nearest to an engine 108 to move toward a rear 109 and out of mixing auger 106. Engine 108 may be coupled to frame 102 and positioned between aggregate bin 104 and mixing auger 106.

Paving system 100 may include an operator cab 110 coupled to frame 102 and positioned between aggregate bin 104 and mixing auger 106. Aggregate bin 104 may be positioned toward an end of paving system 100 which may be a front 112. This may allow for access by a loading vehicle or other similar type of vehicle to deliver aggregate into aggregate bin 104. More specifically, a loading vehicle may maneuver close to aggregate bin 104 at front 112 of paving system 100 and while the loading vehicle travels in the same direction of movement of the still operating paving system 100, the loading vehicle may deliver aggregate into aggregate bin 104.

Paving system 100 may include a conveyor 114 or other movement mechanism that transports aggregate from aggregate bin 104 to mixing auger 106. In some embodiments, paving system 100 may include a baffle 116 that may be operably coupled to or incorporated into the bottom of aggregate bin 104. Baffle 116 may control the amount of aggregate that empties from the bottom of aggregate bin 104 onto conveyor 114, as further described in FIG. 10. Without baffle 116, the full weight of the aggregate in aggregate bin 104 may press against conveyor 114, potentially causing conveyor 114 to stop moving, which may cause damage to various aspects of paving system 100. In addition, without baffle 116, controlling the amount of aggregate on conveyor 114 at any one time may be difficult to implement. In some embodiments, paving system 100 may include a flow gate 118 that may be positioned along a vertical axis that is perpendicular to conveyor 114 and that may control the height (or amount) of the aggregate that may pass under flow gate 118 and be carried by conveyor 114 to mixing auger 106. Flow gate 118 may help to evenly spread the aggregate over conveyor 114.

In some embodiments, paving system 100 may include a resin tank 120 that may be suitable to store resin and an accelerator tank 122 that may be suitable to store an accelerator. A resin line 124 may move resin from resin tank 120 to a resin pump 128. Resin pump 128 may pump the resin out of resin tank 120 through resin line 124 to mixing point 131. Accelerator pump 130 may pump the accelerator out of accelerator tank 122 through accelerator line 126 to a point just past resin pump 128 where accelerator line 126 joins resin line 124 to form a single line to mixing point 131. In some embodiments, a single dual-type pump, such as resin pump 128, may be used to move both accelerator and resin to mixing point 131. A catalyst tank 132, suitable to store a catalyst, may be coupled to a catalyst line 134, also suitable to move a catalyst, from catalyst tank 132 to mixing point 131. Catalyst pump 136 may pump the catalyst out of catalyst tank 132 through catalyst line 134 to mixing point 131. Near mixing point 131, catalyst line 134 and resin line 124 may merge into a singular line in which the catalyst, the resin, and the accelerator are mixed and then placed onto the aggregate just before, just after, or while the aggregate is leaving conveyor 114 and entering mixing auger 106. Mixing auger 106 may then mix the aggregate with the catalyst, the resin and the accelerator. While the resin and the catalyst, once mixed, begin to bond without the accelerator, the accelerator helps to accelerate that chemical bonding process.

In some embodiments, paving system 100 may include a screed 138 that is configured to distribute the mixture of aggregate, catalyst, resin, and accelerator (a "paving mixture") to a ground surface to be paved at a specified height above that ground surface. In some embodiments of paving system 100, the height of screed 138 above the ground surface, and therefore the height of the paving mixture, may be controlled in reference to data transmitted from a sensor 140, which may be a photovoltaic sensor, a sonar sensor or some other suitable form of sensor. Sensor 140 may determine the height of screed 138 above the ground surface and a control box 142 connected to sensor 140 may compare the height of the paving mixture to a height setting for the paving mixture. In an embodiment, control box 142, which may be connected to a positioning system (not shown) of screed 138, may transmit signals to the positioning system to adjust the height of screed 138.

Screed 138 may be extendable (e.g., able to be made wider) by utilizing a bolt on screed 138 extensions with varying lengths. In other embodiments, the system may use a hydraulically, electrically, or mechanically extendable screed 138. The hydraulically, electrically, or mechanically extendable screed 138 may have a maximum and minimum widths but may have numerous position variances within the minimum and maximum widths. The evaluation of screed 138 may be adjusted by a hydraulic device, an electric device, a mechanic device, and/or any combination thereof.

Some embodiments of paving system 100 may include a pair of wheels 144 coupled to engine 108 through which paving system 100 is propelled. Some embodiments of paving system 100 may include two sets of wheels 146 and 148 that may be used to steer the paving system 100. Wheels 146 and 148 may also be driven by engine 108.

Paving system 100 may be fully contained, meaning that it mixes the aggregate and binding material(s) and places the mixture without the need for any additional equipment or apparatus.

Figure 2:
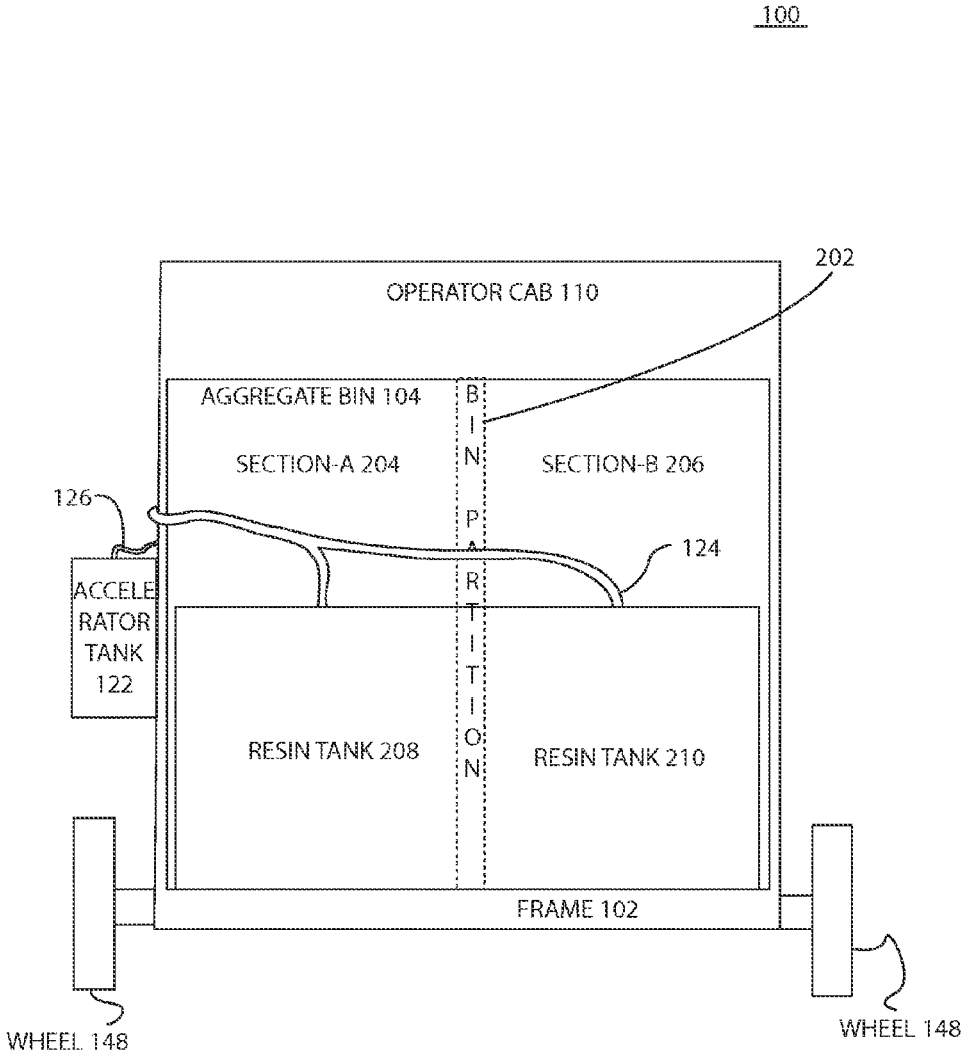
FIG. 2 is a front view illustrating the mixer and placer paving system in accordance with an embodiment.

In FIG. 2, a front view of paving system 100 shows aggregate bin 104 coupled to frame 102, such as by welding, bolting or other manner of coupling. Aggregate bin 104 may include at least one partition 202, illustrated by dashed lines, in the interior of aggregate bin 104. Partition 202 may divide aggregate bin 104 into multiple sections that may store different types and amounts of aggregate materials. For example, Section-A 204 may store gravel and Section-B 206 may store sand. The term aggregate, as used herein, refers to any combination or composition of material used to resist compressive stress, including sand, gravel, crushed stone, slag, recycled and crushed concrete, etc. Accordingly, any combination of these aggregate materials may be held within aggregate bin 104, or multiple aggregate bins 104, and separated into different sections within the one or more aggregate bins 104 by one or more bin partitions 202.

As previously noted, aggregate bin 104 may be positioned towards front 112 of paving system 100, which may provide ready access to aggregate bin 104 by a loading vehicle or other delivery vehicle while paving system 100 may be actively paving a ground surface. More specifically, a loading vehicle or other delivery vehicle may maneuver close to aggregate bin 104 at front 112 of paving system 100, and while the delivery vehicle travels in the same direction as the movement of paving system 100, the delivery vehicle may deliver aggregate into aggregate bin 104, without there being any need to stop the paving operation of paving system 100. The front view of paving system 100 also shows the operator cab 110, positioned up and above the top of aggregate bin 104 so the operator may operate paving system 100 and supervise the loading of aggregate into aggregate bin 104 by the delivery vehicle.

The front view of paving system 100 also shows two resin tanks (208 and 210) that may be suitable to store resin. The front view of paving system 100 also shows accelerator tank 122 that may be suitable to store an accelerator, resin line 124 for moving resin from resin tank 120, and accelerator line 126 for moving an accelerator from accelerator tank 122. Resin tanks 208 may be located at front 112 of paving system 100 so they may also be refilled without stopping the operation of paving system 100. In particular, two resin tanks 208 may be utilized in an embodiment so that one tank may be switched off while the other tank is switched on, thereby providing an uninterrupted flow of resin to mixing point 131 while the switched off resin tank 208 is refilled. In an embodiment, a third resin tank could be used to swap out an empty resin tank 208 so there are always two full or nearly full resin tanks 208 at any time. The delivery vehicle may approach front 112 of paving system 100 and deliver resin and/or resin tanks 208 while paving system 100 is paving a ground surface. Accelerator tank 112 and catalyst tank 132 may be refilled while paving system 100 is in operation, but less of the accelerator and catalyst are used in the paving mixture than aggregate and resin, so the position and refillability of accelerator tank 122 and catalyst tank 132 may be less critical to the continuous operation of paving system 100. The front view of paving system 100 also shows the set of wheels 148.

Figure 3:
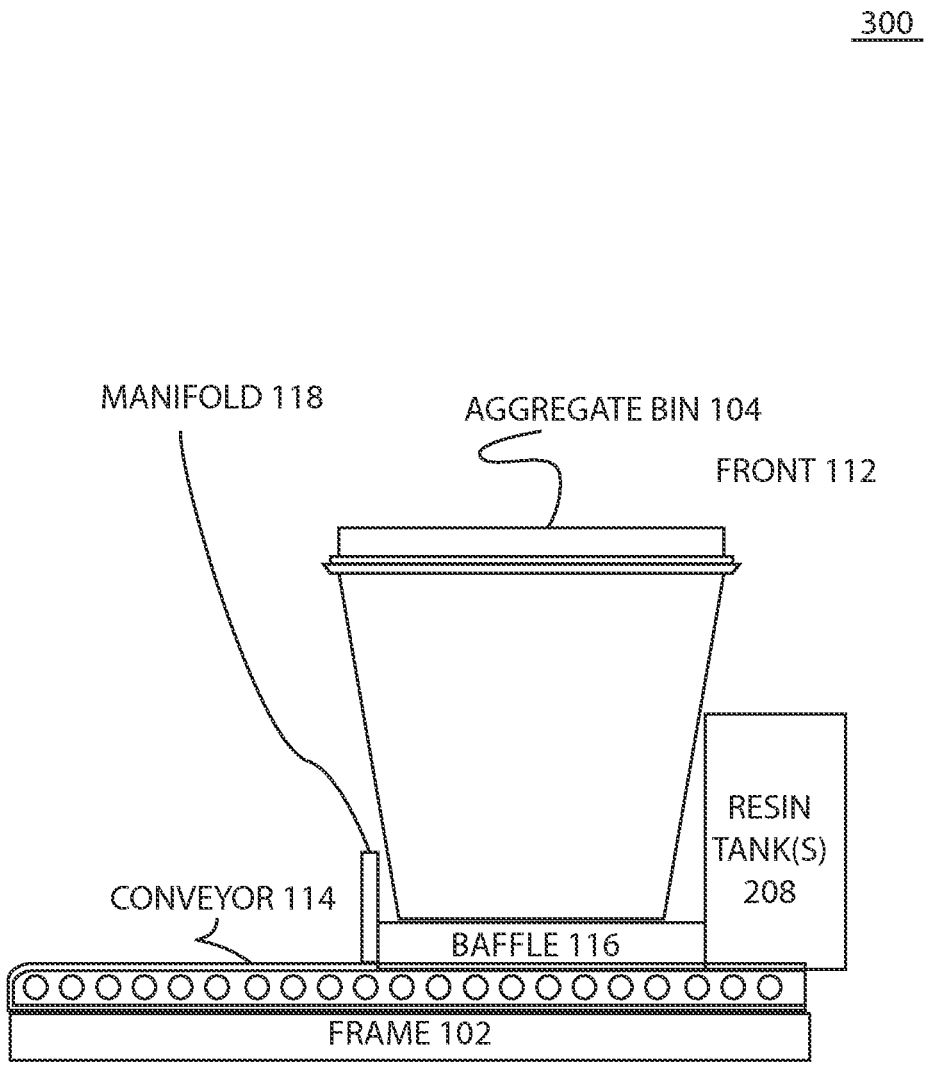
FIG. 3 is a partial side view of an embodiment illustrating the mixer and placer paving system which illustrates the relationship between the aggregate bins, the flow gate, and the conveyor.

In FIG. 3, an embodiment of paving system 100 is illustrated that may include flow gate 118 positioned at the end of aggregate bin(s) 104 and above conveyor 114, which may be coupled to frame 102 by conventional methods. Flow gate 118 may be positioned along a vertical axis that is perpendicular to the direction of movement of conveyor 114. Flow gate 118 may work in conjunction with aggregate bin(s) 104 and/or baffle 116 to control the amount and height of the aggregate that may pass out of aggregate bin(s) 104, under flow gate 118, and onto conveyor 114. Excess aggregate is contained within aggregate bin(s) 104 or baffle 116 (depending on its construction) which may prevent excess aggregate from forming on conveyor 114. The combination of flow gate 118, aggregate bin(s) 104, baffle 116, and the width and speed of conveyor 114 under flow gate 118 may serve to regulate the amount of aggregate flowing onto conveyor 114 during operation of paving system 100.

Figure 4:
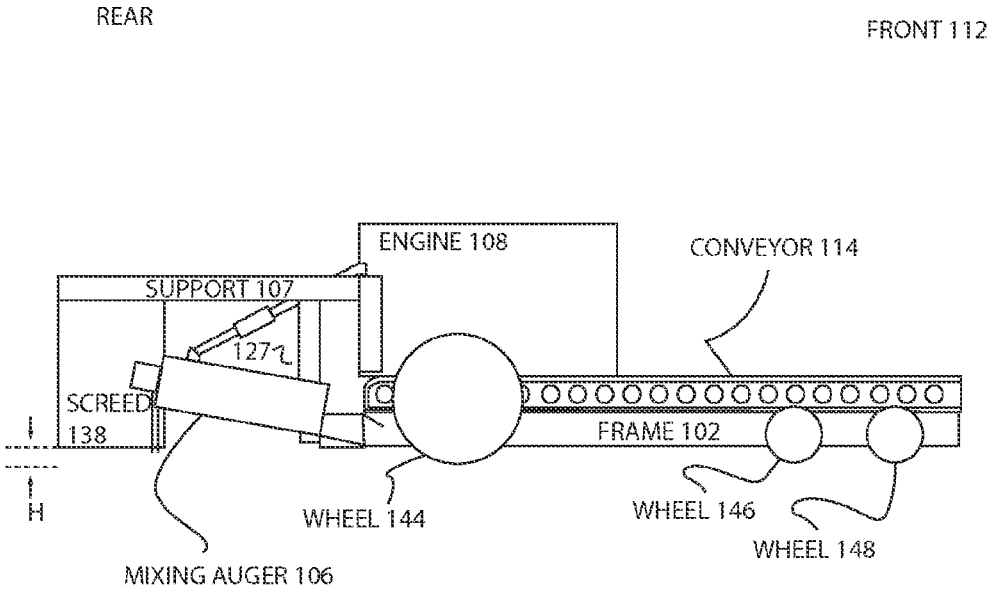
FIG. 4 is a partial side view of an embodiment illustrating the mixer and placer paving system which highlights the support structure.

In FIG. 4, a side view of an embodiment of paving system 100 is illustrated with mixing auger 106 coupled to frame 102 through a second support structure 127. FIG. 4 also shows engine 108 coupled to frame 102, either directly, on the back side of conveyor 114, as illustrated in FIG. 4, or indirectly through other structure (not shown). Paving system 100 illustrated in FIG. 4 may include screed 138 that is supported by and coupled to frame 102 by first support structure 107. Screed 138 may distribute the paving mixture on the ground surface up to a specified height H above the ground surface.

Mixing auger 106 may be a dual auger spinning in counter rotational directions to mix the material, which may reduce the mixing time.

Figure 5:
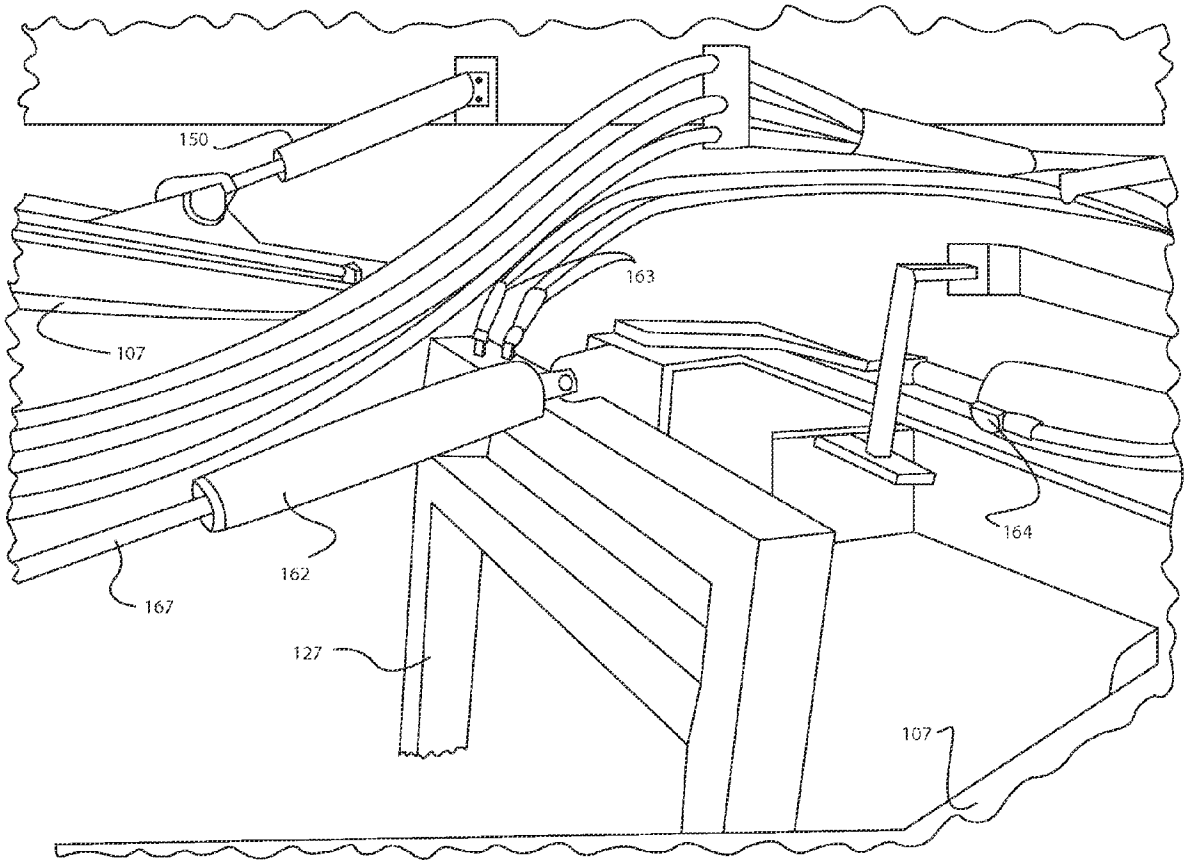
FIG. 5 is an isometric side view of an embodiment of the mixer and placer paving system illustrating various support structures and actuated control mechanisms.

FIG. 5 further illustrates the first support structure 107 and second support structure 127, along with the hydraulic mechanisms, used to control the height H of screed 138 and the distribution of paving mixture from mixing auger 106. In an embodiment, screed 138 may be a trailed floating paving screed that may be articulated up and down via one or more tension arms of first support structure 107 that may be controlled by hydraulic actuating cylinders 150. FIG. 5 illustrates one cylinder 150, but there may be at least one cylinder on each side of paving system 100 separately controlling the height H. Cylinders 150 may be utilized to raise or lower screed 138 to provide additional clearance for paving system 100. In addition, when control box 142 receives data regarding measured heights, control box 142 may send control signals to one or more cylinders (not shown) within the screed 138 causing the one or more cylinders to lower or raise the screed to the desired height H.

As previously noted, the data regarding measured heights may be generated through a number of sources, such as sensor 140, or through other sources. For example, multiple sensors 140 may be attached to and positioned around paving system 100 to collect measured data from multiple different reference points relative to the ground surface. Mechanical sensors and other types of sensors for monitoring the position of the ground surface relative to paving system 100 may also be utilized, such as a string line arrangement, the existing grade and/or a ski control arrangement, as long as each type of sensor communicated appropriate data back to control box 142.

Likewise, the sensors may be set to measure different heights so that an inclined surface may be created by paving system 100. For example, so that water will not collect on a road surface, it is desirable to pave the surface at a slight angle so that water will run off the road surface to a low side of the surface. This may be accomplished by building the foundation of the ground surface to be paved on an incline. This may also be accomplished with paving system 100, by setting the sensors to measure at different heights, or to have control box 142 utilize the measured data, so as to program screed 138 to be at different heights on each side. In this manner, a cylinder on the left side of paving system 100 may be set at height H1 while a different cylinder on the right side of paving system 100 may be set at height H2, where H1 was higher or lower than H2. Cylinders may be separately controlled for this purpose.

Figure 6:
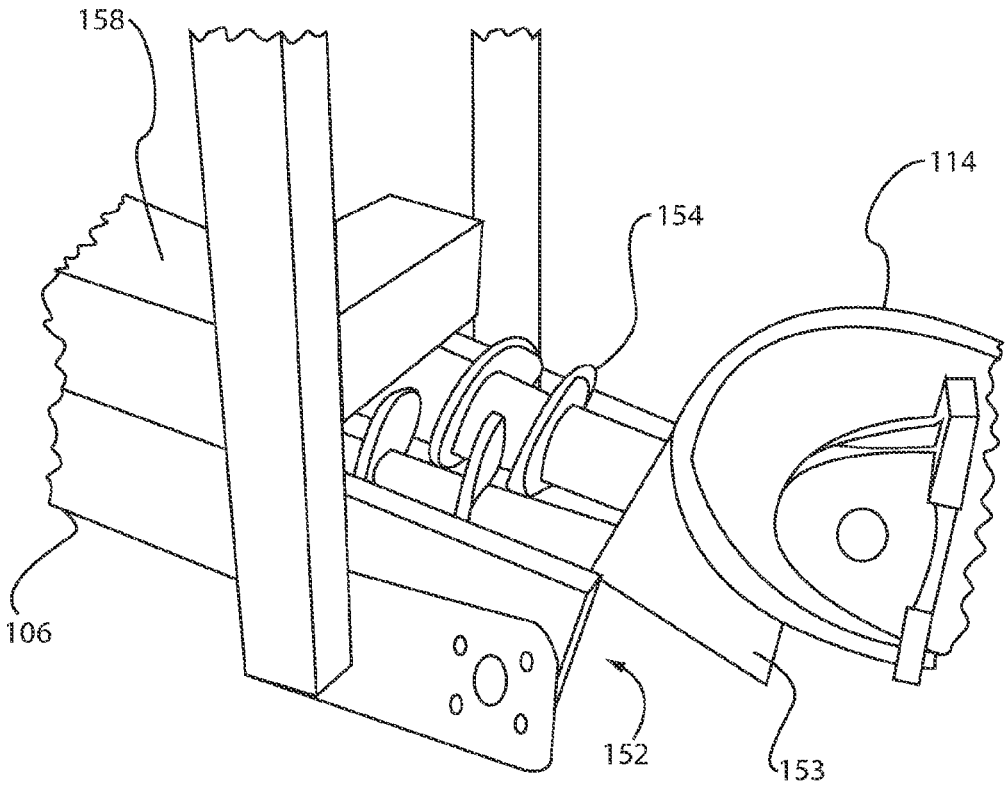
FIG. 6 is an isometric side view of an embodiment of the paving system illustrating a mixing auger, a support structure, and conveyor.
Figure 7:
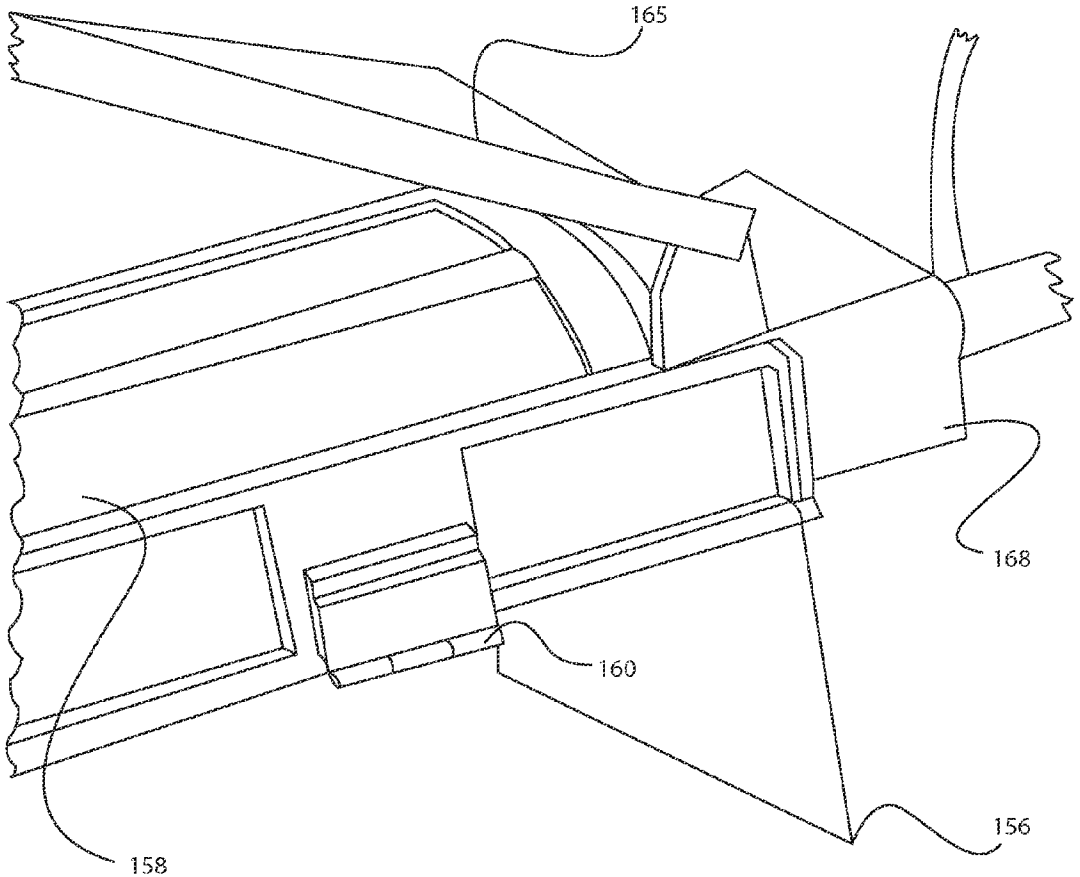
FIG. 7 is an isometric side view of an embodiment of the mixing auger, a delivery point, and a flightings motor.

The operation and control of cylinders may be further illustrated with reference to mixing auger 106, as further illustrated in FIGS. 6 and 7. FIG. 6 illustrates a front 152 of mixing auger 106, where the paving mixture leaves conveyor 114 and enters mixing auger 106. If any aggregate material fails to fall into mixing auger 106 from conveyor 114, that material is deflected by an inclined panel 153 back into mixing auger 106. In the embodiment illustrated in FIG. 6, mixing auger 106 may include two flightings 154, which may be operated in parallel along the length of mixing auger 106, however mixing auger 106 may use a single flighting or more than two flightings, or some other appropriate mechanism for continuing to mix the mixing material and carry the mixing material to a delivery point 156, illustrated in FIG. 7. As illustrated in FIGS. 6 and 7, mixing auger 106 may have a partial cover 158 that starts at a point near front 152 of mixing auger 106, so mixing auger 106 may open at front 152, and may extend to delivery point 156. As illustrated in FIG. 7, partial cover 158 may be attached by hinges 160 on one side and latched on the other so partial cover 158 may be opened and flightings 154 may be cleaned or serviced.

An actuated control cylinder 162 (of FIG. 5) may be coupled to second support structure 127 (of FIG. 5) and an A-frame support 165 (of FIG. 7) by a piston 167 (of FIG. 5), and controlled by control box 142 (of FIG. 1), to raise and lower delivery point 156 as desired. To better explain the operation of any of cylinders (e.g., 150 or 162), the operation of cylinder 162 will be further explained. Electrical lines 163, illustrated in FIG. 5, may run from control box 142 to a control valve (not shown) for actuated control cylinder 162. When it is desired to raise or lower delivery point 156, signals are sent along lines 163 to the control valve, as appropriate, so as to cause actuated control cylinder 162 to extend or withdraw piston 167, thereby raising or lowering delivery point 156.

Likewise, delivery point 156 may be moved from left to right so as to further spread the paving mixture by operation of actuated control cylinder 164, which may cause the end of conveyor 114 and second support structure 127 for mixing auger 106 to swing towards the left or right sides of paving system 100. Articulating delivery point 156 up and down and left and right may allow the operator of the paving machine to precisely control the delivery of paving mixture as desired for different types of paving operations. For example, when a flat surface is being paved at an angle determined by the angle of screed 138, it may be necessary to deliver more paving mixture to the thicker side, thereby requiring delivery point 156 to move from left to right so as to deliver the right amount of paving mixture at the right time. As also illustrated in FIG. 7, mixing auger 106 may include a flightings motor 168 that may be controlled by control box 142 which may turn flightings 154 at a desired speed and direction of rotation so as to further enhance the precise control of the delivery of paving mixture.

Figure 8:
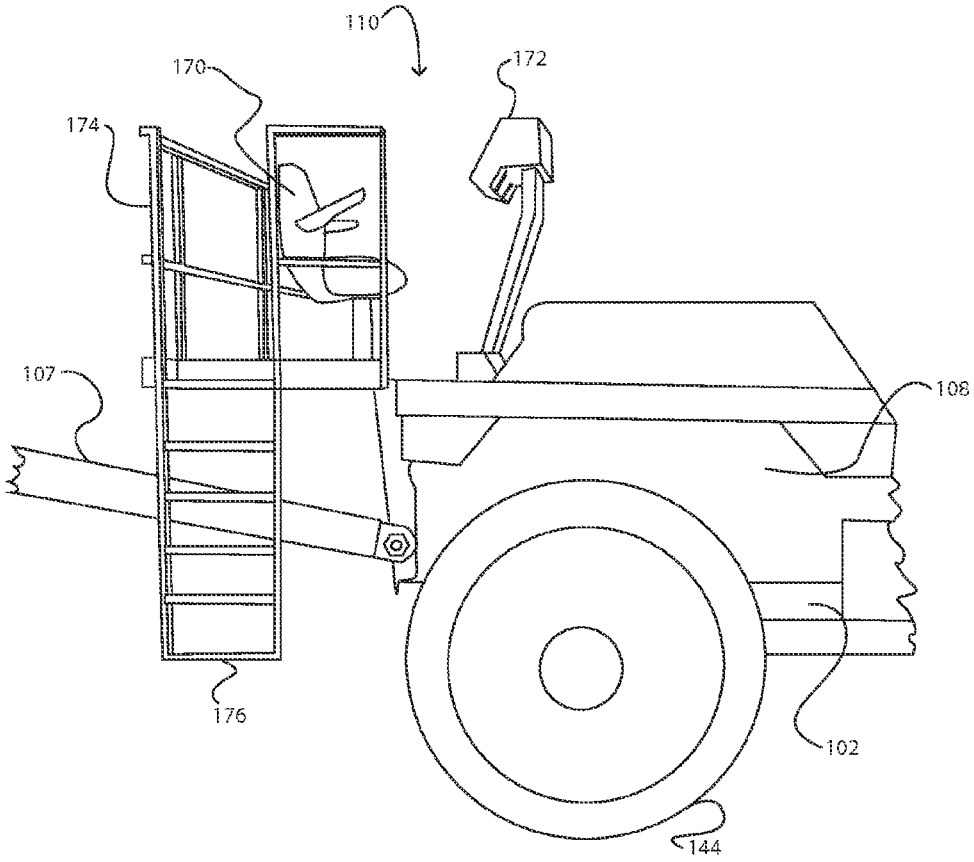
FIG. 8 is a side view of an embodiment of the mixer and placer paving system illustrating a frame, a support structure, an engine, and an operator cab area.

FIG. 8 may be a side view of paving system 100 further illustrating frame 102, first support structure 107, engine 108, operator cab area 110, and wheel 144. As shown in FIG. 8, engine 108 may be mounted to frame 102 between wheels 144 on either side of paving system 100. Operator cab area 110 may be mounted, at least in part, on top of engine 108 and above wheels 144. Operator cab area 110 may include a platform upon which one or more seats 170 and a control panel 172 are mounted. Control panel 172 may include a steering wheel (not shown) and other controls for managing the operation of paving system 100. An accelerator control and braking control may be configured as pedals to be operated by the operator's feet, or as hand controls and incorporated into control panel 172. A guard rail 174, partially shown in FIG. 8, may serve to prevent the operator(s) from falling off of paving system 100, and a ladder 176 may provide access to operator cab area 110 from the ground.

Figure 9:
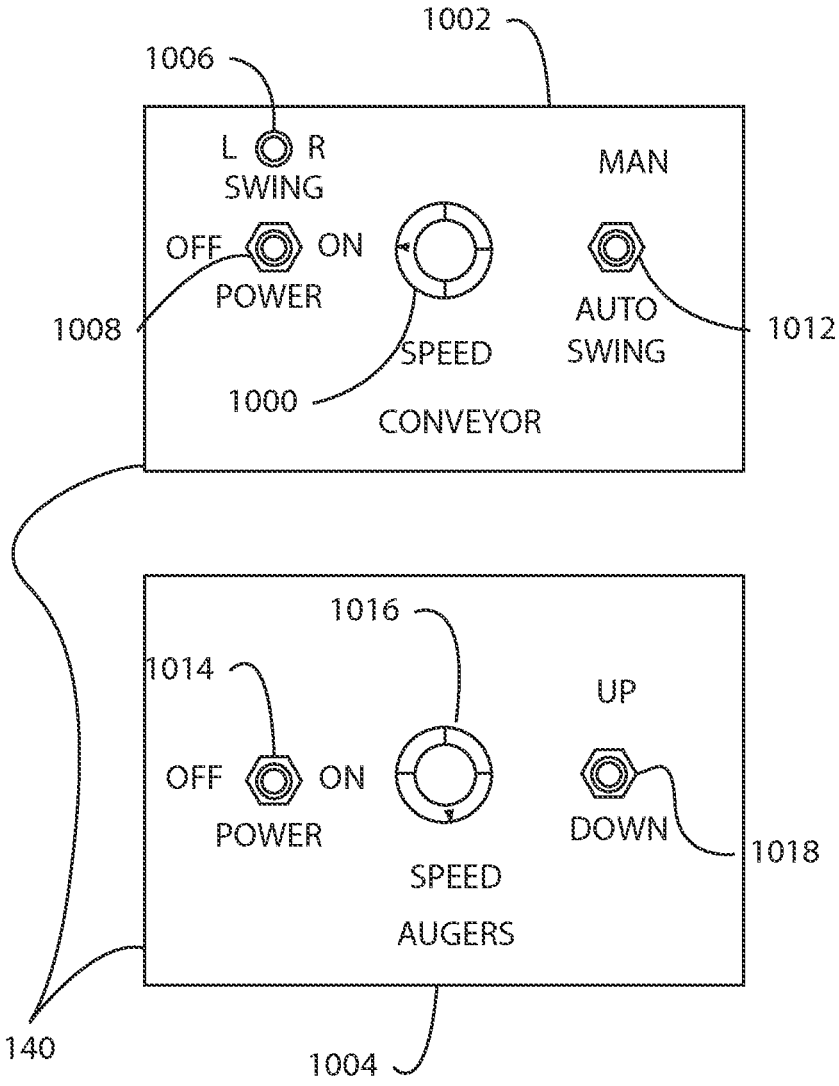
FIG. 9 is an illustration of a control box.

FIG. 9 illustrates an embodiment of control box 142. In some embodiments, control box 142 may include two sections, a conveyor section 1002 that may control conveyor 114 and actuated cylinder 164, and an auger section 1004, which may control mixing auger 106 and actuated cylinder 162. In some embodiments, conveyor section 1002 of control box 142 may include a toggle switch 1006 for manually swinging conveyor 114 left or right. Flipping toggle switch 1006 left might cause mixing auger 106 to swing left and flipping the toggle switch 1006 to the right might cause mixing auger 106 to swing right. A toggle switch 1008 may control the power ON or OFF to conveyor 114, a dial 1000 may control the speed of conveyor 114, and a toggle switch 1012 may allow mixing auger 106 to be set for either manual swing (in conjunction with toggle switch 1006) or auto swing mode, where mixing auger 106 may be automatically shifted from left to right at a predetermined speed. That predetermined speed may be set within control box 142 or adjusted by controls available to the operator at control panel 172.

In some embodiments, mixing auger section 1004 of control box 142 may include a toggle switch 1014 for turning power ON or OFF to mixing auger 106, a dial 1016 for controlling the speed of the two flightings 154 of mixing auger 106, and a toggle switch 1018 for moving mixing auger 106 up or down. While the functions of control box 142 are described in reference to a control box 142 illustrated in FIGS. 1 and 9 so control box 142 may be accessed by a person standing alongside paving system 100, the functions of control box 142 may also be incorporated into control panel 172, or incorporated into both control panel 172 and control box 142, with either the controls on control panel 172 or the controls on control box 142 may be configured to override the other. The various functions of control box 142 may also be controlled in different ways from manual switches and dials, such as being incorporated into electrical circuitry and controlled by different types of control mechanisms, such as touch sensitive panels that allow the operator to control mixing auger 106 and conveyor 114. Likewise, the function of control box 142 may be implemented in a software control system that is managed through a graphical user interface available at a display panel of control box 142 and/or or at a display panel at control panel 172.

Figure 10:
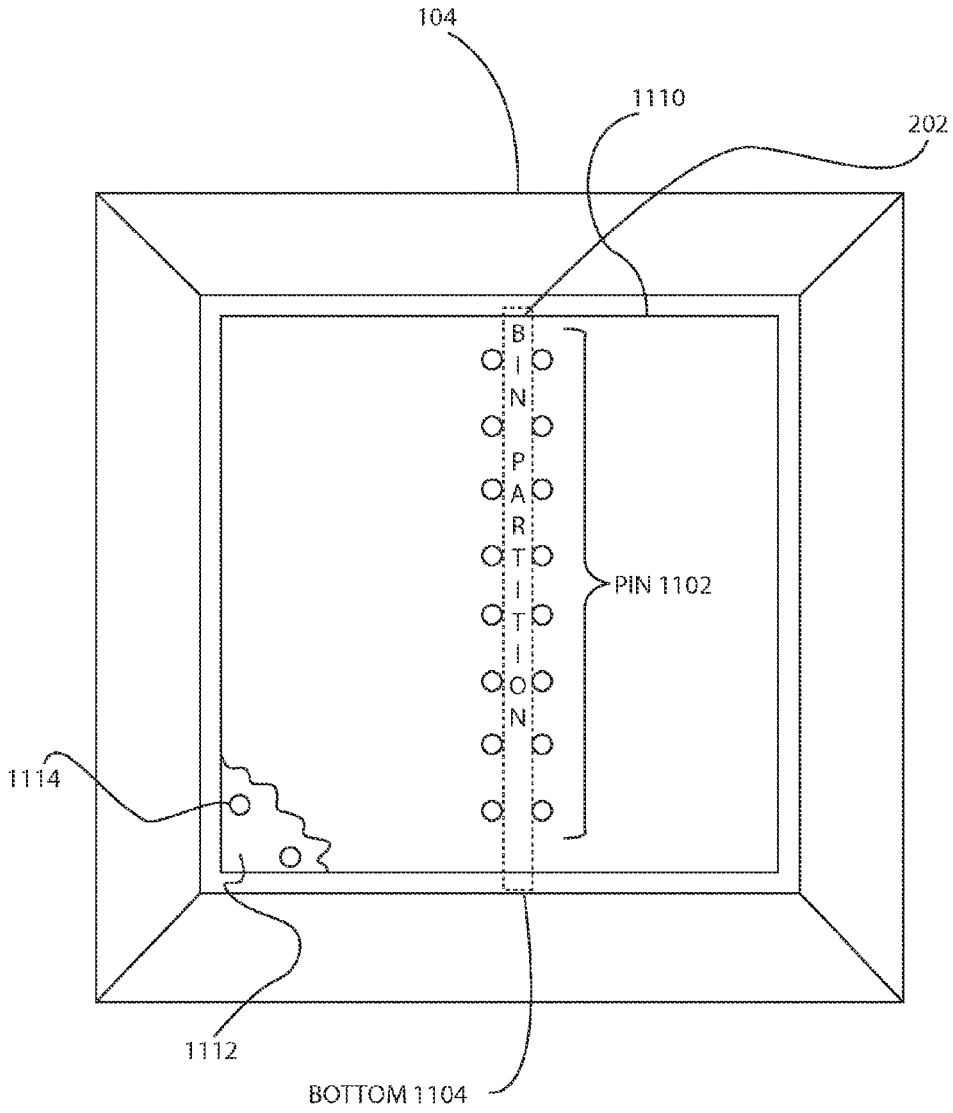
FIG. 10 is a top view of an embodiment of the mixer and placer paving system illustrating the inside of an aggregate bin with a single partition and various configurations of the baffle system.

FIG. 10 may be a top view of an aggregate bin illustrating a fixed apparatus for holding a partition in the center of the aggregate bin. In the embodiment shown in FIG. 10, an apparatus for holding partition 202 in place may be a series of raised pins 1102 located at a bottom 1104 of aggregate bin 104. Partition 202 may be positioned vertically in aggregate bin 104, but partition 202 may not be attached to bottom 1104 so partition 202 could be easily moved and/or removed. Partition 202 may be removed from bottom 1104 by pulling it up above pins 1102 or reinstalled by placing it back between pins 1102 on bottom 1104. Thus, partition 202 is removable. Other retaining members could be used to hold partition 202 in place instead of pins, such as brackets, blocks, and other members of almost any conceivable shape and size. While numerous pins 1102 are illustrated, as few as two pins could be used, one on either side of partition 202.

Figure 11:
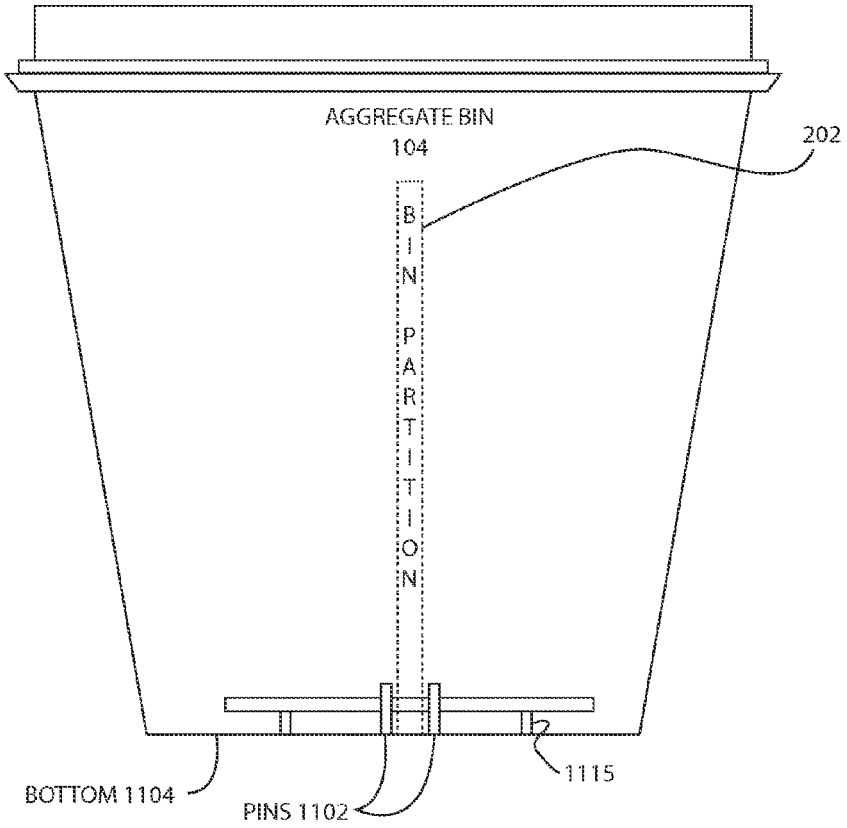
FIG. 11 is a side view of an embodiment of the mixer and placer paving system illustrating the inside of an aggregate bin with a single partition.

Pins 1102 or other retaining members may also be movably attached to bottom 1104 of aggregate bin 104, such as placing each pin in a hole from which they may be supported and removed when desired. Alternatively, pins 1102 may be fixedly attached to bottom 1104, such as by welding each pin in a desired place. In addition, partition 202 could be directly welded, bolted or otherwise more securely attached to bottom 1104 without the need for pins 1102 or other retaining members. FIG. 11 may be a side view of aggregate bin 104 of FIG. 10 further illustrating pins 1102 in relation to aggregate bin 104 and partition 202.

In an embodiment where baffle 116 is incorporated into aggregate bin 104, baffle 116 may be comprised of a plate 1110 that may be positioned near bottom 1104. Plate 1110 may have a slightly smaller circumference than bottom 1104 so that aggregate may flow between the gap created between plate 1110 and bottom 1104, thereby allowing aggregate to move to bottom 1104 of aggregate bin 104 and onto conveyor 114, but without introducing the full weight of the aggregate on conveyor 114, since plate 1110 would hold most of the weight of the aggregate. Plate 1110 may be attached to aggregate bin 104 in many different ways, such as being attached at each corner by welding, supported by some structure 1115 underneath plate 1110 as illustrated in FIG. 11, or in many other ways.

In an embodiment, a different plate 1112 may be used in place of plate 1110. Different plate 1112 may completely cover bottom 1104, such that its circumference was the same as the circumference of bottom 1104, in which case different plate 1112 and bottom 1104 may be the same object, or different plate 1112 may have a smaller circumference, like plate 1110, and be positioned above bottom 1104, as illustrated in FIG. 11. Regardless of the circumference and/or location of different plate 1112, different plate 1112 may include a number of additional holes 1114 that allows aggregate to flow through different plate 1112 and onto conveyor 114 in a controlled manner. Regardless of whether plate 1110 or different plate 1112 is used, if the plate is different from bottom 1104, it might be necessary to form holes in the plate so that pins 1102 may go through the plate and contact bin partition 202, so as to hold bin partition 202 in place.

Figure 12:
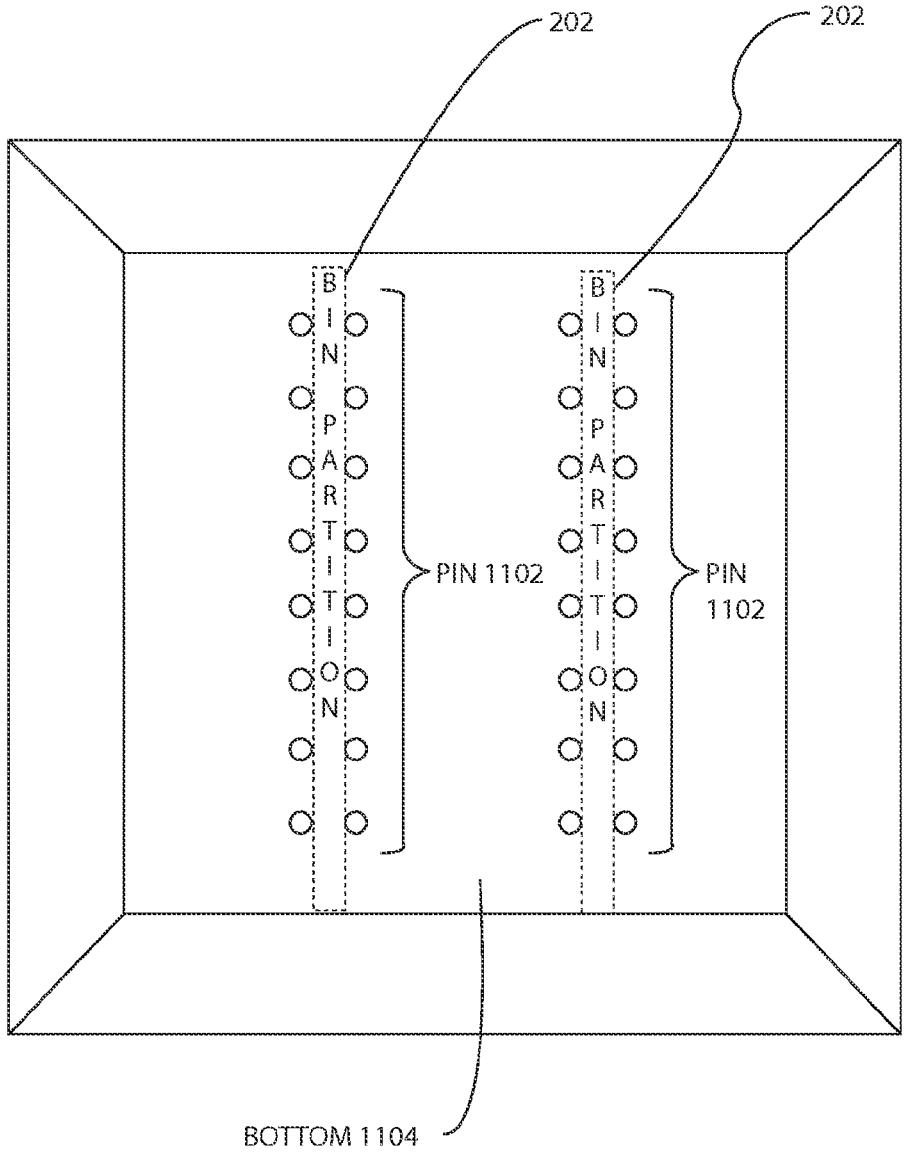
FIG. 12 is a top view of an embodiment of the mixer and placer paving system illustrating an aggregate bin with multiple partitions.
Figure 13:
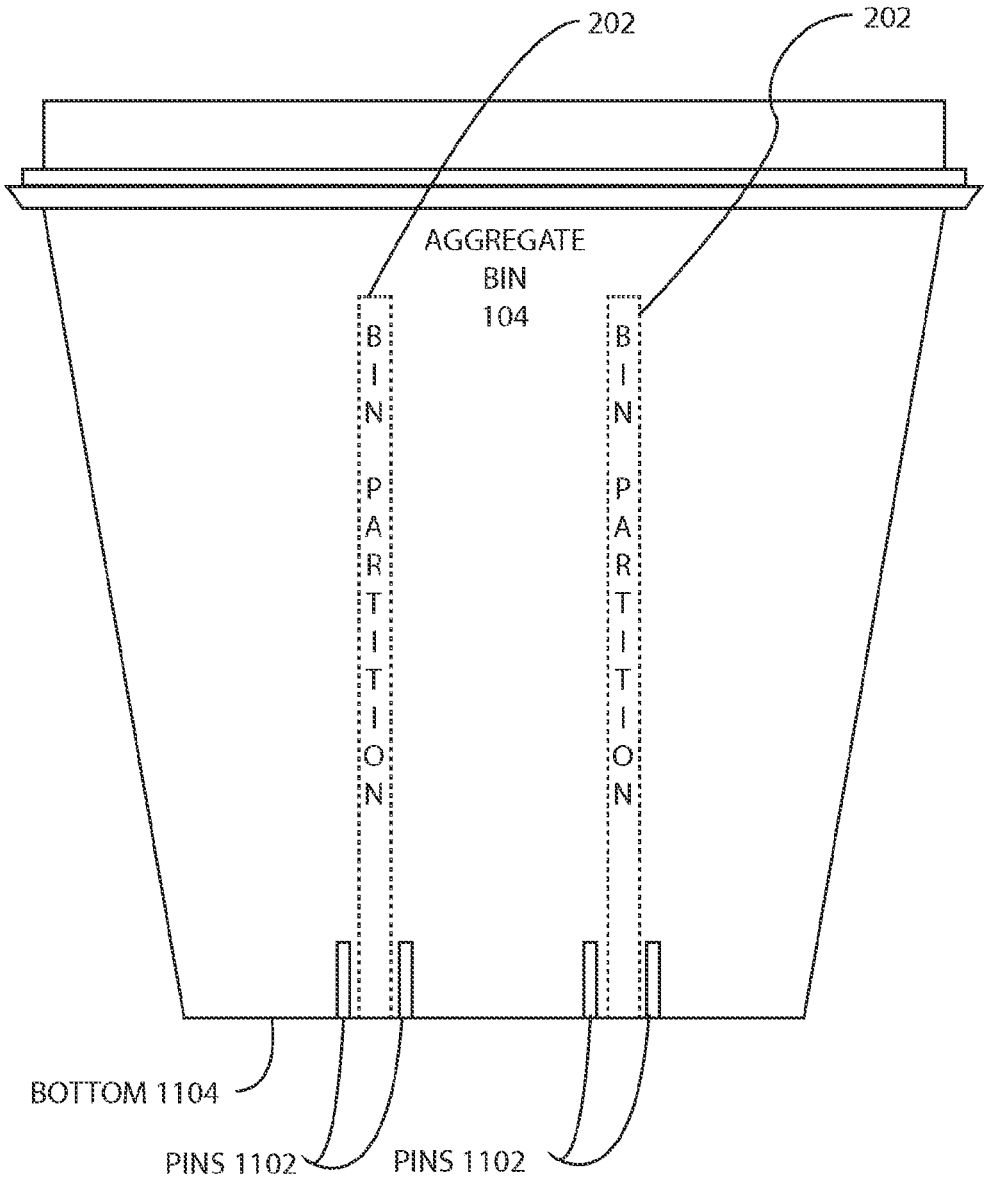
FIG. 13 is a side view of an embodiment of the mixer and placer paving system illustrating an aggregate bin with multiple partitions.

In FIG. 12, a top view of aggregate bin 104 illustrating a fixed apparatus for holding multiple partitions in aggregate bin 104 is shown. In the embodiment shown in FIG. 12, the apparatus for holding two partitions 202 is two series of pins. As with the embodiment illustrated in FIGS. 10 and 11, pins 1102 may be located at bottom 1104 of aggregate bin 104. Partitions 202 may be positioned vertically in aggregate bin 104, but partition 202 may not be attached to bottom 1104. Partitions 202 may be removed from bottom 1104 or placed back between pins 1102 on bottom 1104. Thus, partitions 202 may be removable. Pins 1102 may be movably attached or fixedly attached to bottom 1104. FIG. 13 may be a side view of aggregate bin 104 of FIG. 12 illustrating the two sets of pins 1102 in relation to aggregate bin 104 and two partitions 202.

Figure 14:
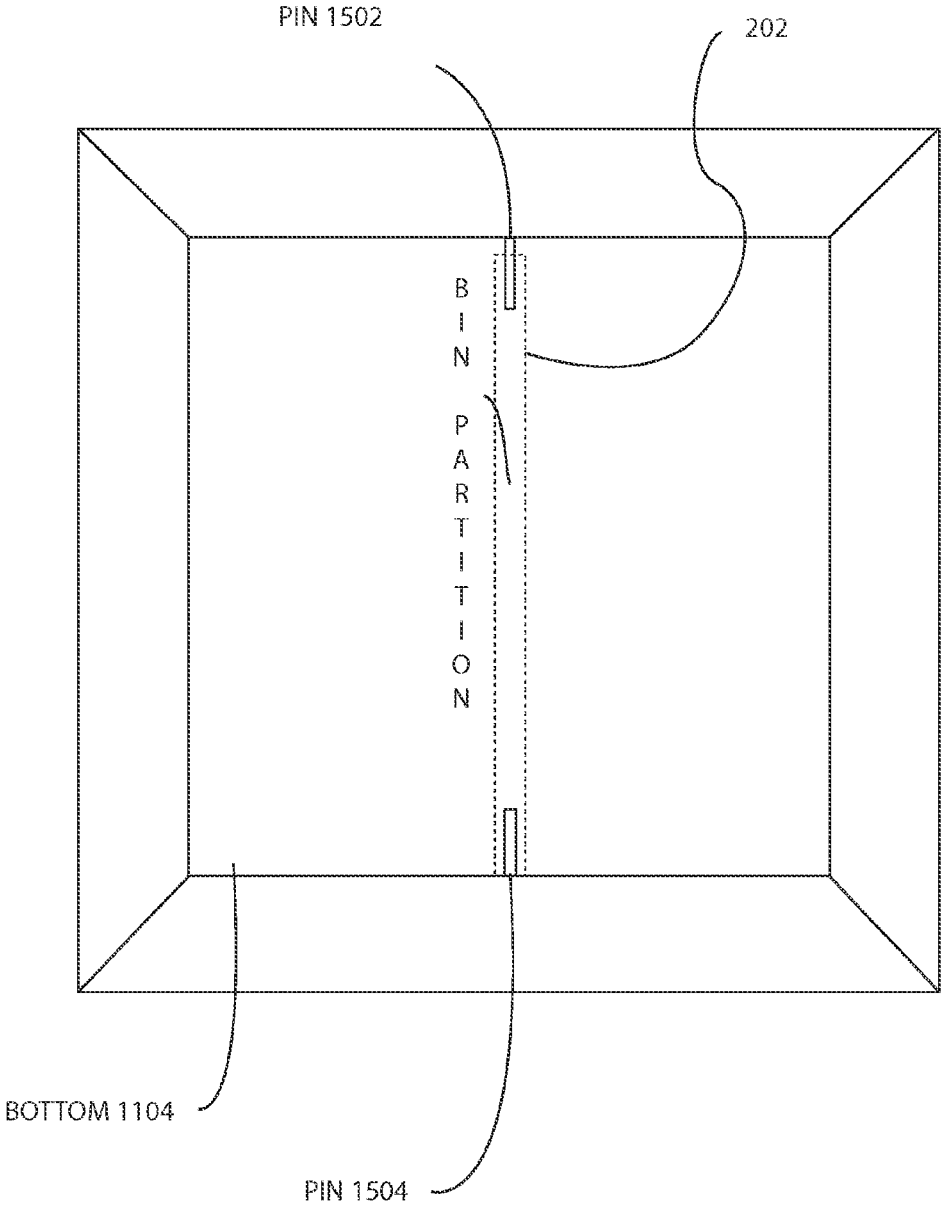
FIG. 14 is a top view of an embodiment of the mixer and placer paving system illustrating an aggregate bin with a rotatable partition.
Figure 15:
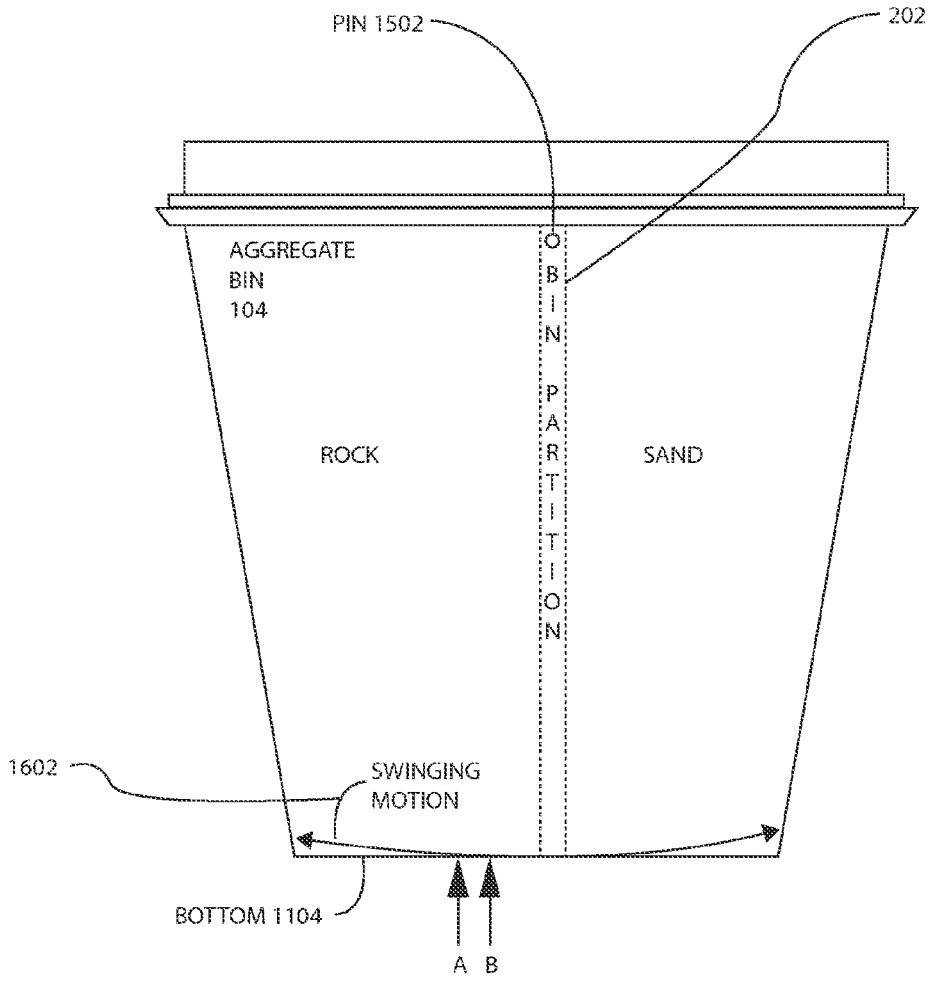
FIG. 15 is a side view of an embodiment of the mixer and placer paving system further illustrating the rotatable partition highlighting configurations where the bin partitions may be separated for different aggregate mixtures.

In FIG. 14, a top view of aggregate bin 104 illustrating an embodiment of a rotatable apparatus for holding a partition in the center of aggregate bin 104 is shown. In the embodiment shown in FIG. 14, the apparatus for holding partition 202 in place is two pins 1502 and 1504. Pins 1502 and 1504 may be attached to the side of aggregate bin 104. Partition 202 may be positioned vertically in aggregate bin 104, but partition 202 may not be attached to bottom 1104. Partition 202 may therefore be swung or rotated from one side of bottom 1104 to the other side of bottom 1104, thus partition 202 is rotatable, which is further illustrated in FIG. 15. FIG. 15 may be a side view of aggregate bin 104 with partition 202 swinging in the direction of swing motion 1602 about the pins 1502 and 1504. Partition 202 may be positioned vertically in aggregate bin 104, but partition 202 may not be attached to bottom 1104, thus partition 202 may be swung or rotated from one side of bottom 1104 to the other side of bottom 1104 in swing motion 1602.

To change the volume of aggregate material that may be stored on one side of aggregate bin 104 from the other side, partition 202 may be swung in one direction of the swing motion 1602, and then held in place at the desired location, such as by a block or clamp located on the bottom or side of aggregate bin 104. Moving the position of partition 202 from a center position to a left or right position changes the volume of aggregate material that may be stored on one side of aggregate bin 104 from the other, but also changes the volume of material that may exit bottom 1104 of aggregate bin 104 at one time. Thus, if it was desired to having an aggregate ratio mix of other than a 1:1 ratio of one type of aggregate, such as crushed rock, from another type of aggregate, such as sand, which as noted in FIG. 15 may be achieved by leaving partition 202 in the centered position, partition 202 may be moved to the left or right to change that ratio. Moving the bottom of partition 202 from the centered position to position A would create 3:1 ratio of sand to rock, while moving the bottom of partition 202 from the centered position B would create a 2:1 ratio of sand to rock.

Figure 16:
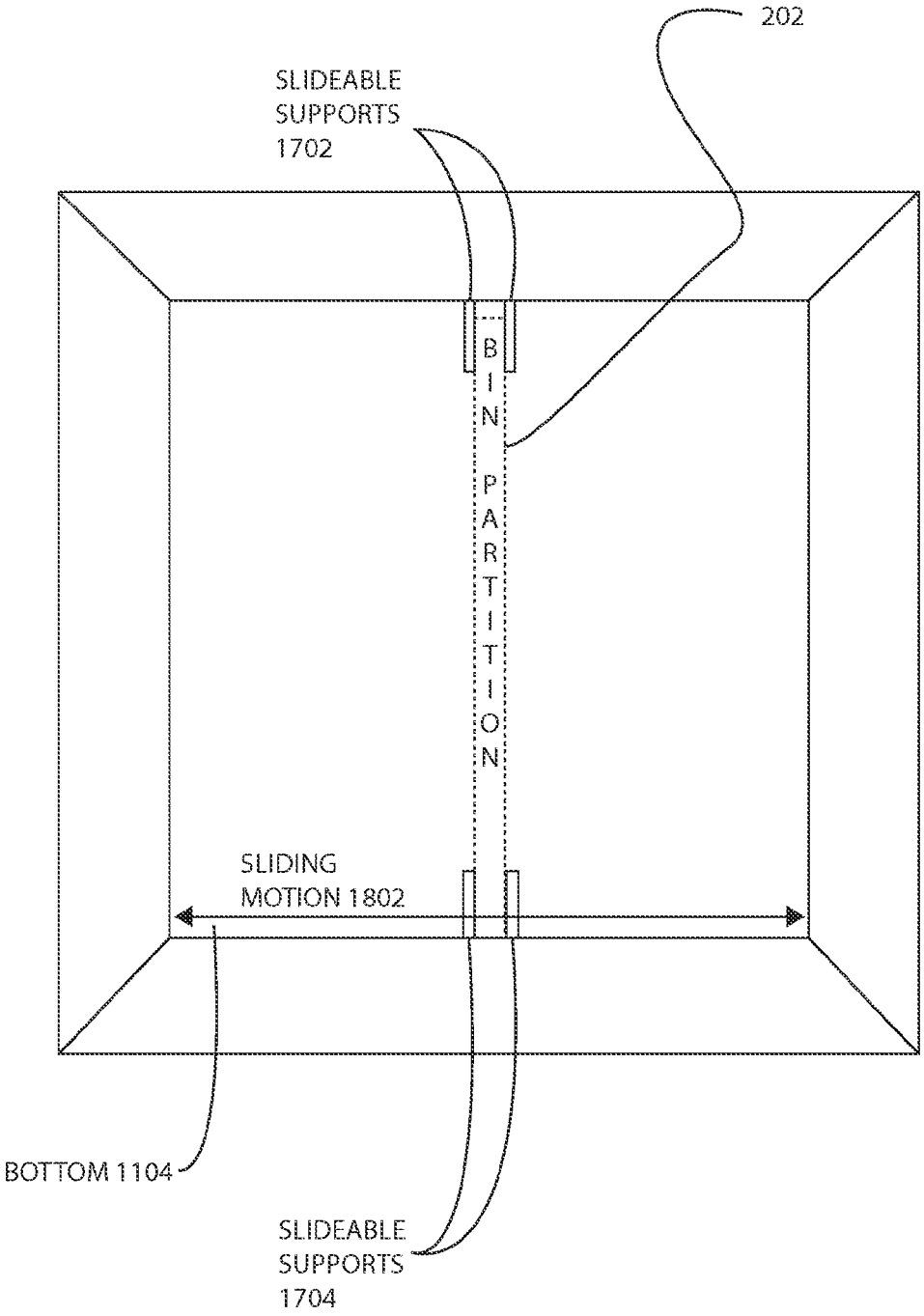
FIG. 16 is a top view of an embodiment of the mixer and placer paving system illustrating an aggregate bin with a slideable partition.

In FIG. 16, a top view of an embodiment of aggregate bin 104 illustrating a different type of partition positioning system is shown. In the embodiment shown in FIG. 16, the apparatus for holding partition 202 is two supports 1702 and 1704. Supports 1702 and 1704 may be slideably attached to the side of aggregate bin 104 and slide in the direction of sliding motion 1802 so as to create different aggregate ratios. Partition 202 may be positioned vertically in aggregate bin 104, but partition 202 may not be attached to bottom 1104. Partition 202 may be slid from one side of bottom 1104 to the other side of bottom 1104, thus partition 202 may be slideable. Alternatively, two supports 1702 and 1704 may be affixed to different locations within aggregate bin 104 to create different aggregate ratios.

Figure 17:
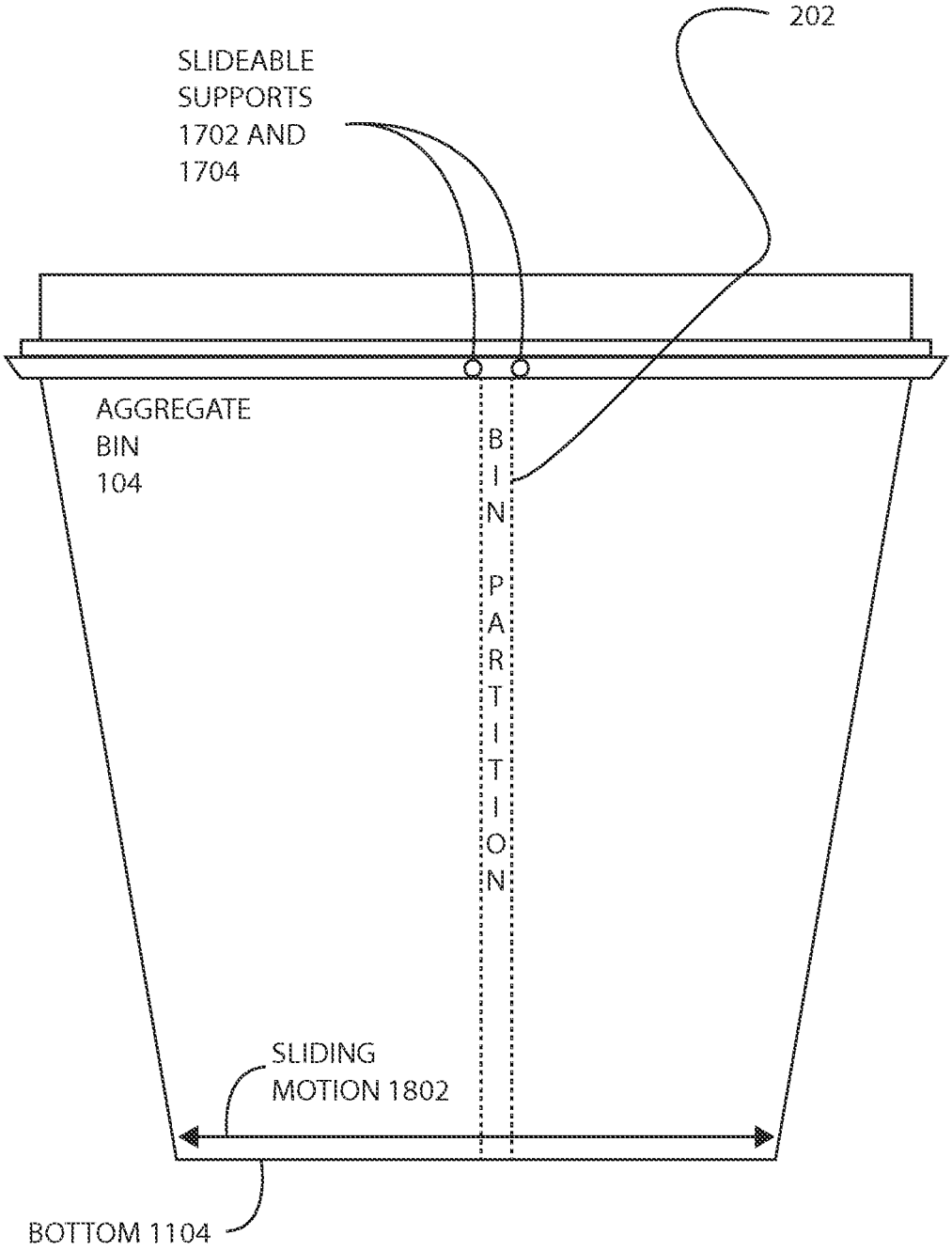
FIG. 17 is a side view of an embodiment of the mixer and placer paving system further illustrating the slideable partition.

FIG. 17 is a side view of a further embodiment of aggregate bin 104, in which two supports 1702 and 1704 may be located on the inside of aggregate bin 104. Partition 202 may be positioned vertically in aggregate bin 104, but partition 202 may not be attached to bottom 1104. Partition 202 may be slid from one side of bottom 1104 to the other side of bottom 1104 along slide motion 1802, thus partition 202 may be slideable. In FIG. 17, supports 1702 and 1704 may be located at the top of the inside of aggregate bin 104. However, other embodiments, the slideable apparatus supports 1702 and 1704 may be located below the top of aggregate bin 104. In some embodiments, aggregate bin 104 may include multiple pairs of supports 1702 and 1704; in which case multiple pairs of supports 1702 and 1704 may be aligned vertically to hold bin partition 202 at multiple positions up and down bin partition 202; or in other cases in which multiple pairs of supports 1702 and 1704 may position and hold multiple bin partitions 202.

In various embodiments, a paving system for mixing and placing a paving material at a delivery point may include a frame and one or more aggregate bins for holding an aggregate material. The paving system may be coupled to the frame at a front position relative to a direction of travel of the paving system. The paving system may include a resin system which may deliver a resin to a mixing point and a catalyst system which may deliver a catalyst to the mixing point. The paving system may include a mixing auger coupled to the frame at a rear position relative to the direction or travel and configured to receive the aggregate material, the resin and the catalyst to create the paving material. The paving system may include an engine coupled to the frame and positioned between the one or more aggregate bins and the mixing auger. The paving system may include an operator cab coupled to the frame and positioned between the one or more aggregate bins and the mixing auger. The paving system may include a conveyor system coupled to the frame and positioned at least partially underneath the one or more aggregate bins and between the front position and the rear position. The conveyor system may be operative to convey the aggregate material exiting the one or more aggregate bins to the mixing auger for mixing the paving material and placing the paving material at the delivery point.

The paving system may include an accelerator system which may deliver an accelerator to the mixing point. The resin system may include one or more resin tanks, a resin pump, and one or more resin lines connecting the one or more resin tanks to the resin pump and the resin pump to the mixing point. The catalyst system may include a catalyst tank, a catalyst pump, and a catalyst line connecting the catalyst tank to the catalyst pump and the catalyst pump to the mixing point. The accelerator system may include an accelerator tank, an accelerator pump, and an accelerator line connecting the accelerator tank to the accelerator pump and the accelerator pump to the mixing point.

The operator cab may be positioned at a point where an operator can supervise the mixing and placing of the paving material at the delivery point and supervise a delivery of new aggregate material to the aggregate bins. The paving system may include a controller which may control operation of the conveyor system and the mixing auger. The mixing auger may include one or more flightings for mixing the aggregate material with the resin and the catalyst starting at the mixing point and ending at the delivery point. The controller may control a speed of the conveyor system, a speed of the flightings, a side to side movement of the mixing auger, an up and down movement of the mixing auger, and/or any combination thereof.

The paving system may include a screed which may spread the paving material on a roadway. The paving system may include a sensor which may determine a height at which the paving material should be spread on the roadway at least at a first point. The paving system may include a second sensor which may determine a second height at which the paving material should be spread on the roadway at least at a second point. The first point may be on a first side of the screed and the second point may be on a second side of the screed. The paving system may utilize one sensor, two sensors, or any number of sensors.

Some portions of the detailed description included herein are presented in terms of algorithms or symbolic representations of operations on binary digital signals stored within a memory of a specific apparatus or special purpose computing device or platform. In the context of this particular specification, the term specific apparatus or the like includes a general purpose computer once it is programmed to perform particular operations pursuant to instructions from program software. Algorithmic descriptions or symbolic representations are examples of techniques used by those of ordinary skill in the signal processing or related arts to convey the substance of their work to others skilled in the art. An algorithm is here, and is generally, considered to be a self-consistent sequence of operations or similar signal processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals, or the like. It should be understood, however, that all of these or similar terms are to be associated with appropriate physical quantities and are merely convenient labels. Unless specifically stated otherwise, as apparent from the discussion herein, it is appreciated that throughout this specification discussions utilizing terms such as "processing," "computing," "calculating," "determining" or the like refer to actions or processes of a specific apparatus, such as a special purpose computer or a similar special purpose electronic computing device. In the context of this specification, therefore, a special purpose computer or a similar special purpose electronic computing device is capable of manipulating or transforming signals, typically represented as physical electronic or magnetic quantities within memories, registers, or other information storage devices, transmission devices, or display devices of the special purpose computer or similar special purpose electronic computing device.

Reference throughout this specification to "one example," "an example," "another example," and/or "embodiment" should be considered to mean that the particular features, structures, or characteristics may be combined in one or more examples.

While the present disclosure illustrates and describes a preferred embodiment and several alternatives, it is to be understood that the techniques described herein can have a multitude of additional uses and applications. Accordingly, the disclosure should not be limited to just the particular description and various drawing figures contained in this specification that merely illustrate various embodiments and application of the principles of such embodiments.

The invention claimed is:

1. A system for delivering a paving material to a point, comprising:

a frame;

one or more aggregate bins coupled to the frame at a front position relative to a forward direction of travel of the system, the aggregate bins configured to hold an aggregate material;

a resin device configured to deliver a resin to a mixing point;

a catalyst device configured to deliver a catalyst to the mixing point;

a mixing auger coupled to the frame and the mixing auger configured to receive the aggregate material, the resin, and the catalyst to create the paving material;

an engine coupled to the frame configured to propel the frame down a roadway;

an operator cab coupled to the frame; and a conveyor system coupled to the frame and positioned at least partially underneath the one or more aggregate bins, the conveyor system being operative to convey the aggregate material exiting the one or more aggregate bins to the mixing auger and delivering the paving material to the point; wherein the operator cab is positioned between the one or more aggregate bins and the point and is configured so as to allow an operator to supervise a mixing and placing of the paving material and to supervise a new aggregate material delivery to the one or more aggregate bins.

2. The paving system according to claim 1, further comprising an accelerator device configured to deliver an accelerator to the mixing point.

3. The paving system according to claim 2, wherein the resin device includes one or more resin tanks, a resin pump, and one or more resin lines connecting the one or more resin tanks to the resin pump and the resin pump to the mixing point, and wherein the catalyst device includes a catalyst tank, a catalyst pump, and one or more catalyst lines connecting the catalyst tank to the catalyst pump and the catalyst pump to the mixing point, and wherein the accelerator device includes an accelerator tank, an accelerator pump, and one or more accelerator lines connecting the accelerator tank to the accelerator pump and the accelerator pump to the mixing point.

4. The paving system according to claim 1, wherein the resin device includes one or more resin tanks, a resin pump, and one or more resin lines connecting the one or more resin tanks to the resin pump and the resin pump to the mixing point.

5. The paving system according to claim 1, further comprising a controller configured to control an operation of at least one of the conveyor systems and the mixing auger.

6. The paving system according to claim 5, wherein the mixing auger includes one or more flightings for mixing the aggregate material with the resin and the catalyst.

7. The paving system according to claim 1, further comprising a screed configured to spread the paving material onto a roadway.

8. The paving system according to claim 7, further comprising a sensor configured to determine a height to spread the paving material onto a first point.

9. The paving system according to claim 8, wherein the paving material is spread evenly onto the roadway.

10. The paving system according to claim 8, further comprising a second sensor configured to determine a second height to spread the paving material onto a second point, wherein the first point is on a first side of the screed and the second point is on a second side of the screed.

11. The paving system according to claim 8, wherein the paving material is spread based on data from a photovoltaic sensor.

12. The paving system according to claim 1, wherein each of the one or more aggregate bins further comprise:

a vertical partition dividing each bin into two sections from a bottom of each bin to a top of each bin.

13. The paving system according to claim 12, wherein the vertical partition is rotatably mounted within each bin.

14. The paving system according to claim 13, wherein the aggregate material is formed of one or more aggregate materials, wherein the vertical partition is configured to be rotatable positioned to create a desired aggregate mixture of the one or more aggregate material.

15. A system for delivering a paving material to a point, comprising:

a frame;

one or more aggregate bins coupled to the frame at a front position relative to a forward direction of travel of the system, the aggregate bins configured to hold an aggregate material, wherein each of the one or more aggregate bins further includes a vertical partition dividing each bin into two sections from a bottom of each bin to a top of each bin, wherein the vertical partition is configured to be slidably mounted within each bin;

a resin device configured to deliver a resin to a mixing point;

a catalyst device configured to deliver a catalyst to the mixing point;

a mixing auger coupled to the frame and the mixing auger configured to receive the aggregate material, the resin, and the catalyst to create the paving material;

an engine coupled to the frame;

an operator cab coupled to the frame; and a conveyor system coupled to the frame and positioned at least partially underneath the one or more aggregate bins, the conveyor system being operative to convey the aggregate material exiting the one or more aggregate bins to the mixing auger and delivering the paving material to the point.

16. The paving system according to claim 15, wherein the aggregate material is formed of one or more aggregate materials, wherein the vertical partition is configured to be slidably positioned to create a predetermined aggregate mixture of the one or more aggregate material.

17. The paving system according to claim 12, wherein the vertical partition is configured to be removably mounted within each bin.

18. The paving system according to claim 1, further comprising a baffle configured to prevent the aggregate material from pressing on the conveyor system.

19. The paving system according to claim 18, wherein the baffle includes a plate mounted within the one or more aggregate bins, and wherein the plate is configured to allow aggregate material to flow around at least one plate side.

20. The paving system according to claim 19, wherein the plate includes a plurality of holes formed within the plate is configured to allow aggregate material to flow through the plurality of holes.

21. The paving system according to claim 18, wherein the baffle includes a plate mounted within the one or more aggregate bins, and wherein a plurality of holes are formed within the plate, the plurality of holes being configured to allow aggregate material to flow through the plurality of holes.

22. The paving system according to claim 1, further comprising a flow gate configured to regulate an amount of aggregate material on the conveyor system.

* * * * *